US005678486A

United States Patent [19]

Bachmeir et al.

[11] Patent Number: 5,678,486

[45] Date of Patent: Oct. 21, 1997

[54] GRIPPER CYLINDER

[75] Inventors: Xaver Bachmeir, Augsburg; Eckhard Tusché, Bobingen; Johannes Ruschkowski, Augsburg, all of Germany

[73] Assignee: MAN Roland Druckmaschinen AG, Offenbach am Main, Germany

[21] Appl. No.: 761,331

[22] Filed: Dec. 10, 1996

Related U.S. Application Data

[63] Continuation of Ser. No. 529,498, Sep. 18, 1995, abandoned.

[30] Foreign Application Priority Data

Sep. 20, 1994 [DE] Germany ..... 44 33 380.3

[51] Int. Cl.[6] ..... B41F 21/04

[52] U.S. Cl. ..... 101/409; 101/246

[58] Field of Search ..... 101/232, 246, 101/408, 409, 410, 411; 271/247, 277; 355/285, 288, 291, 294, 295

[56] References Cited

U.S. PATENT DOCUMENTS

| | | | |
|---|---|---|---|
| 3,768,406 | 10/1973 | Gutsche et al. | 101/409 |
| 3,937,142 | 2/1976 | Cerny et al. | 101/409 |
| 5,125,334 | 6/1992 | Marx et al. | 101/408 |
| 5,333,547 | 8/1994 | Pfisterer et al. | 101/409 |

FOREIGN PATENT DOCUMENTS

| | | |
|---|---|---|
| 0061607 | 10/1982 | European Pat. Off. . |
| 259237 | 5/1913 | Germany . |
| 2113750 | 10/1971 | Germany . |

*Primary Examiner*—Ren Yan

*Attorney, Agent, or Firm*—Cohen, Pontani, Lieberman & Pavane

[57] ABSTRACT

A gripper cylinder configurable as a printing cylinder of a sheet-fed printing machine, a feeder drum in a sheet-fed printing machine, or a gripper cylinder in a folder unit. The gripper cylinder includes a stationary stator and a gripper spindle assembly mounted to the cylinder. The gripper spindle assembly includes a gripper pivotably mounted to a gripper support. Instead of using a mechanical cam, the gripper can be controllably pivoted together with a cam roller by an armature that can be magnetized but is not permanently magnetic when an electric current flows through the stator thereby magnetizing a housing of the stator. The armature may be magnetically urged against the restoring force of a spring.

19 Claims, 4 Drawing Sheets

GRIPPER CYLINDER

This is a continuation of application Ser. No. 08/529,498, filed Sep. 18, 1995, now abandoned.

BACKGROUND OF THE INVENTION

1. Field of the Invention

The present invention relates to gripper cylinders and, in particular, a gripper cylinder having an electro-magnetically controlled gripper for selectively gripping and transporting a sheet of paper.

2. Description of the Prior Art

Gripper cylinders such, for example, as printing cylinders are used in sheet-fed printing machines. In order to securely hold a sheet, the gripper cylinder must be equipped with a gripper which typically takes the form of a gripper row having a plurality of grippers. The grippers of the gripper row take the sheet from, for example, a feeder drum or a feeder table and, after the sheet is printed, transport the sheet to a transfer drum using a delivery guide. The transfer drum is also a gripper cylinder in the sense that it performs, in part, a similar function. Gripper cylinders are also included in folder units.

Known gripper cylinders such, for example, as the sheet transfer cylinder disclosed in European publication EP 0 061 607 B1, mechanically controls the opening and closing of the grippers through the use of control cams. The control cam forms either an internal cam or an external cam, against which a cam roller or follower is resiliently urged by a pre-stressed spring. The external and internal cams thus function as "forced" or mechanical control of the cam roller. There are one-sided as well as two-sided axial cams. A disadvantage of these prior art cam systems is that the cam roller repeats a pre-established path after each rotation. If the desired path of the cam roller or the gripper is not to repeat upon every rotation of the gripper cylinder, but rather, for example, once every second rotation, then a second control cam is needed. This scenario occurs in the case of a gripper-and-collecting cylinder in a folder unit. The second control cam, together with the first control cam, will then produce the desired periodical motion. This is also true when the gripper cylinder is designed or configured as a printing cylinder of a sheet-fed printing machine. In one example, the printing cylinder transports a sheet, either through a rubber-blanketed cylinder or directly over a form cylinder having a circumference that is several times the circumference of the printing cylinder. For example, the form cylinder may be equipped with four printing forms thus requiring the printing cylinder to hold the sheet securely for four rotations so as to completely print the four printing forms. Thus, in this case, the number of rotations that the printer cylinder must hold the sheet corresponds to the ratio of the circumference of the form cylinder to the circumference of the printing cylinder.

German publication DE-PS 259 237 discloses a gripper closing device for a gripper cylinder of a printing machine. The device includes an electromagnet located within the gripper cylinder and controlled through a stationary contact slide. The electromagnet moves an armature located on the gripper shaft when an electric current flows through the electromagnet and thereby inducing a magnetic field around the armature.

German application DE-AS 21 13 750 discloses a gripper cylinder with a gripper, its movement in either the clockwise and counterclockwise directions is controlled by a pair of electromagnets positioned within the gripper cylinder. Both electromagnets are subjected to electrical current by means of a slip-ring slide located outside of the gripper cylinder.

SUMMARY OF THE INVENTION

An object of the present invention is to provide a gripper for a gripper cylinder that is electromagnetically controllable in a simple manner.

Another object of the invention is to control the gripper without the use of contact slides.

Still another object of the invention is to position the stator in a stationary manner on an end face of the gripper cylinder.

Yet another object of the invention is to provide a gripper which engages or disengages a sheet in a manner that is asynchronous with the number of rotations of the gripper cylinder or that it only engages or disengages at a selected portion or "nth" number of rotations of the gripper cylinder.

In accordance with an embodiment of the present invention, an electromagnet is positioned outside of the gripper cylinder in a stationary manner. Through the magnetic induction produced in the armature by the electromagnet, control can be exercised in a simple manner without using contact slides, since the electromagnet does not rotate along with the gripper cylinder.

According to another embodiment, a simple control mechanism is provided such that movement of the gripper is asynchronous with the number of rotations of the gripper cylinder, i.e., the gripper only moves at a selected portion or "nth" number of rotation of the gripper cylinder.

Therefore, the gripper control mechanism of the present invention represents a considerable simplification over the mechanical structure of the prior art. Accordingly, the present invention permits a more compact design than is disclosed or taught by the prior art.

Advantageously, even though there is only a single control cam, the cam path need not be repeated at every rotation of the gripper cylinder. In other words, it is possible to implement any desired timing control of the gripping action of the gripper. Not only does a second control cam become unnecessary, but so do the springs and cam roller that are typically associated therewith.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not drawn to scale and, as such, are merely conceptual in disclosing the preferred embodiments of the invention.

BRIEF DESCRIPTION OF THE DRAWINGS

In the drawings, wherein like reference characters denote similar elements throughout the several views.

DETAILED DESCRIPTION OF THE PRESENTLY PREFERRED EMBODIMENTS

Figure 1:
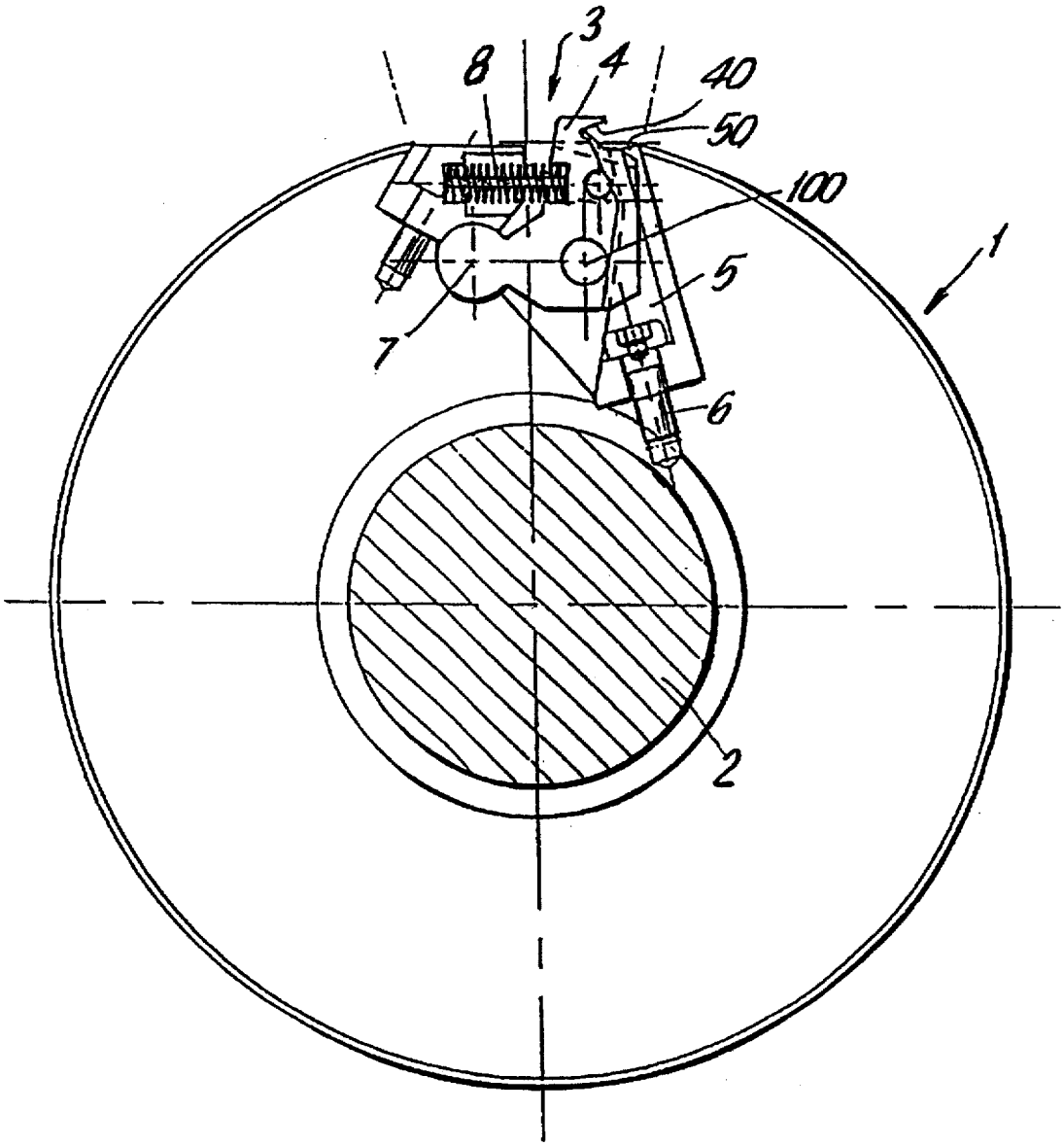
FIG. 1 is a side view of an embodiment of the gripper cylinder with a gripper constructed in accordance with the present invention.

As depicted in FIG. 1, an embodiment of the gripper cylinder 1 is rotatably mounted on a shaft 2 in a printing machine. The gripper cylinder 1 has a gripper spindle assembly 3 that includes at least one gripper 4 for clamping a printed copy or sheet against a bearing surface of a gripper support 5. The gripper support 5 may, for example, be attached with a screw 6 to the cylinder body of the gripper cylinder 1. The gripper 4 is swingably or pivotably mounted about a pivot point 7. A spring 8, preferably, a compression spring, having a first end and a second end may, for example, be attached to the gripper 4 at its first end and to the cylinder body of the gripper cylinder 2 at its second end. The spring 8 may be so arranged that it resiliently urges a bottom edge 40 of the gripper 4 onto an upper edge 50 of the bearing surface of the gripper support 5 so as to securely hold an end of a sheet. Alternatively, the spring 8 may be so arranged that the gripper is biased to stay open or disengage from the bearing surface of the gripper support 5. FIG. 1 shows the gripper spindle assembly 3 in the open position.

Figure 2:
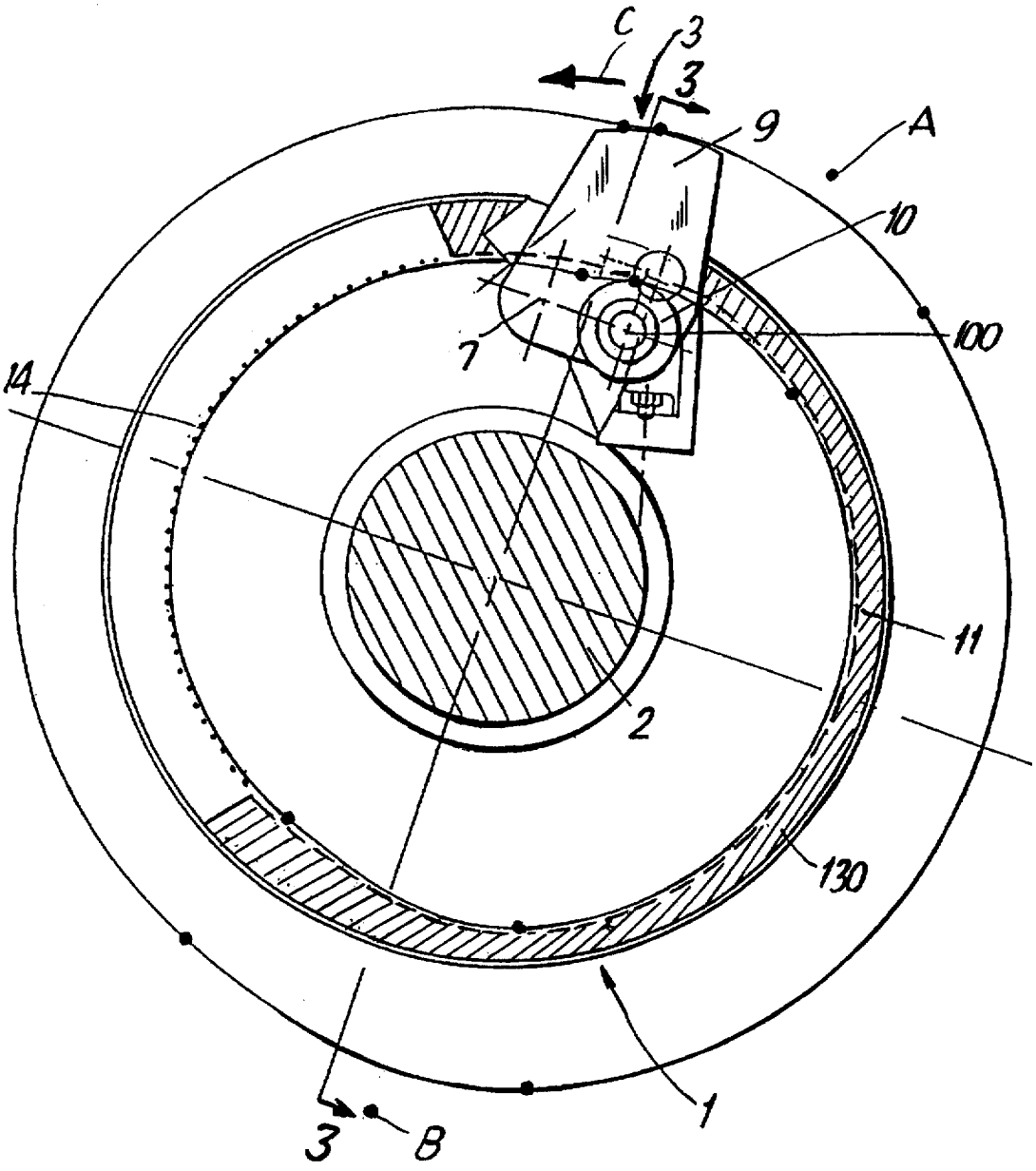
FIG. 2 is a side view of the gripper cylinder with an armature of FIG. 1.

Referring now to FIG. 2, a cam roller 10 is rotatably mounted about a rotation point 100 on the gripper spindle assembly 3 and which can be swung or rotated, together with an armature 9, around pivot point 7. As long as there is no magnetic field produced in or about the armature 9 by a current flowing in an electromagnet of a stationary stator 12, the gripper spindle assembly 3 would be resiliently biased by the spring 8 in a rotated position about pivot point 7 toward the shaft 2 of the gripper cylinder 1, so that the gripper 4 remain in a clamped or closed position (or open position). The stator 12 is preferably configured as an arcuate section or annular ring as shown by the broken line in area 11 of FIG. 2. In the area 11, a protruding lip 130 of a housing 13 of the stationary stator 12 forms an external cam control for controlling movement of the cam roller 10. When an electrical current flows through the stator 12 and thereby magnetizing the housing 13 of the stator, the magnetic force induced causes the armature 9 to be attracted to the lip 130 in the area 11 and therefore presses the cam roller 10 against the external cam formed by the lip 130. Both the armature 9 and the housing 13 consist of a material that can be magnetized but is not permanently magnetic. When the gripper of the gripper spindle assembly 3 is opened at, for example, Point A, it takes a sheet from a feed drum and rotates or turns this sheet in the general direction of an arrow C, clockwise or counterclockwise, into area 14 (as indicated by dots in FIG. 2). Since the stator 12 is absent in area 14, the gripper 4 would be once again closed by the restoring torque or force of the spring 8.

In another embodiment, the stator 12 is configured as a concentric or annular ring surrounding the gripper cylinder 1 on the end face, and lip 130 is accordingly present in the areas 11 and 14. The cam roller 10 is swung or pivoted in the area 14 in a forcibly-controlled manner in the direction of the shaft 2 and holds the sheet securely there until again entering the area 11, even when an electrical current is flowing through the stator 12.

In summary, each of the aforementioned embodiments could securely hold, for as long as necessary, a sheet that has been gripped by the grippers 4, either by means of the compressive force of the spring 8 alone and/or by the forced control of the stator 12 configured as concentric or annular rings in the area 14, and then, at the desired or appropriate moment releases the sheet by producing a magnetic field in the housing 13 of the stator 12 in the area 11. The sheet may then be transported to, for example, a delivery guide arranged at Point B.

Thus, for example, if the gripper cylinder 1 is configured as a printing cylinder in a sheet-fed printing machine, and the sheet is to be printed with four colors by a form cylinder that is four times larger than the printing cylinder, then the sheet must remain on the external surface of the printing cylinder for four rotations of the printing cylinder before being transported to a delivery guide. Accordingly, in this example, a magnetic field need to be produced in or about the housing 13 only during the fourth rotation of the printing cylinder 1 before the sheet moves from area 14 into area 11 so that the armature 9 is swung or pivoted away from the shaft 2 thereby releasing the sheet from the gripper 4.

Figure 3:
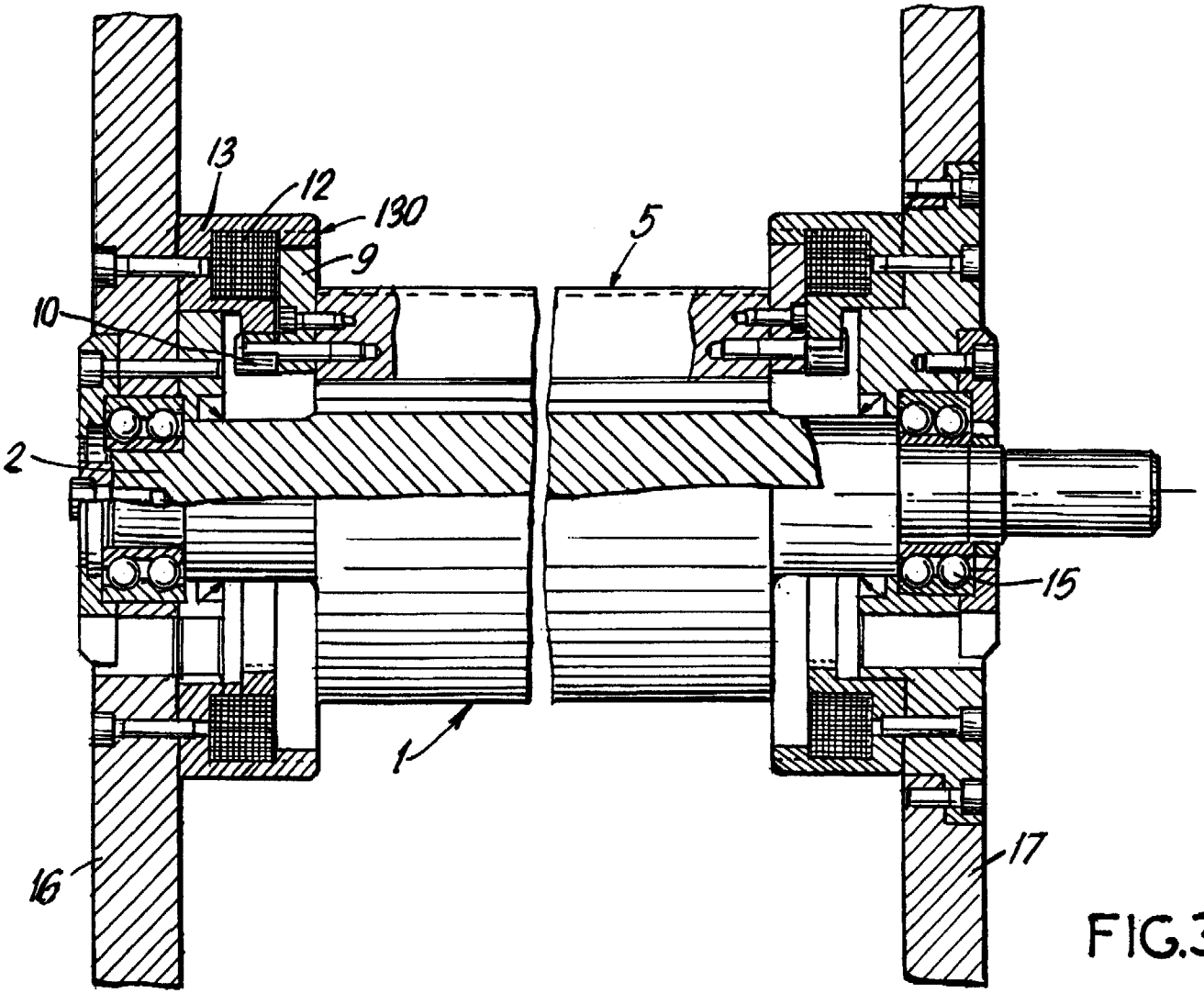
FIG. 3 is a cross-sectional view through the gripper cylinder along lines 3—3 of FIG. 2.

FIG. 3 shows that the gripper cylinder 1 could, for example, be rotatably mounted on double ball bearings 15 between side walls 16 and 17.

In sum, the present invention provides a gripper cylinder 1 which may be configured either as the printing cylinder of a sheet-fed printing machine, or as the feeder drum or transfer drum in a sheet-fed printing machine, or as the gripper cylinder of a folder unit.

Instead of controlling the gripper 4 with a mechanical cam as disclosed by prior art, the present invention provides an embodiment in which the gripper 4 can be made swingable with an armature 9 that can be magnetized but is not permanently magnetic. Moreover, the armature 9 can be swung or pivoted jointly together with a cam roller 10, when an electric current flows through a stator 12 and magnetizes a housing of the stator 12. In this manner, the armature 9 is magnetically attracted toward the housing 13 and thereby urges against the restoring torque of the spring 8.

It is contemplated that instead of guiding the cam roller 10 on an external cam, as shown in FIG. 2, the cam roller 10 may be guided or controlled in an equivalent or similar manner along an internal cam. The internal cam may be formed by configuring the stator 12 as an annular ring between the shaft 2 and the cam roller 10 such that the stator 12 is surrounded by a housing that is similar to the housing 13 depicted in FIGS. 2 and 3.

It is further contemplated that instead of providing only a single gripper spindle assembly 3 having a plurality of grippers 4, there may be provided a plurality of gripper spindle assemblies such, for example, as three gripper spindle assemblies 3 distributed about the circumference of the gripper cylinder 1. Of course, each gripper assembly may include a plurality of grippers.

Figure 4A:
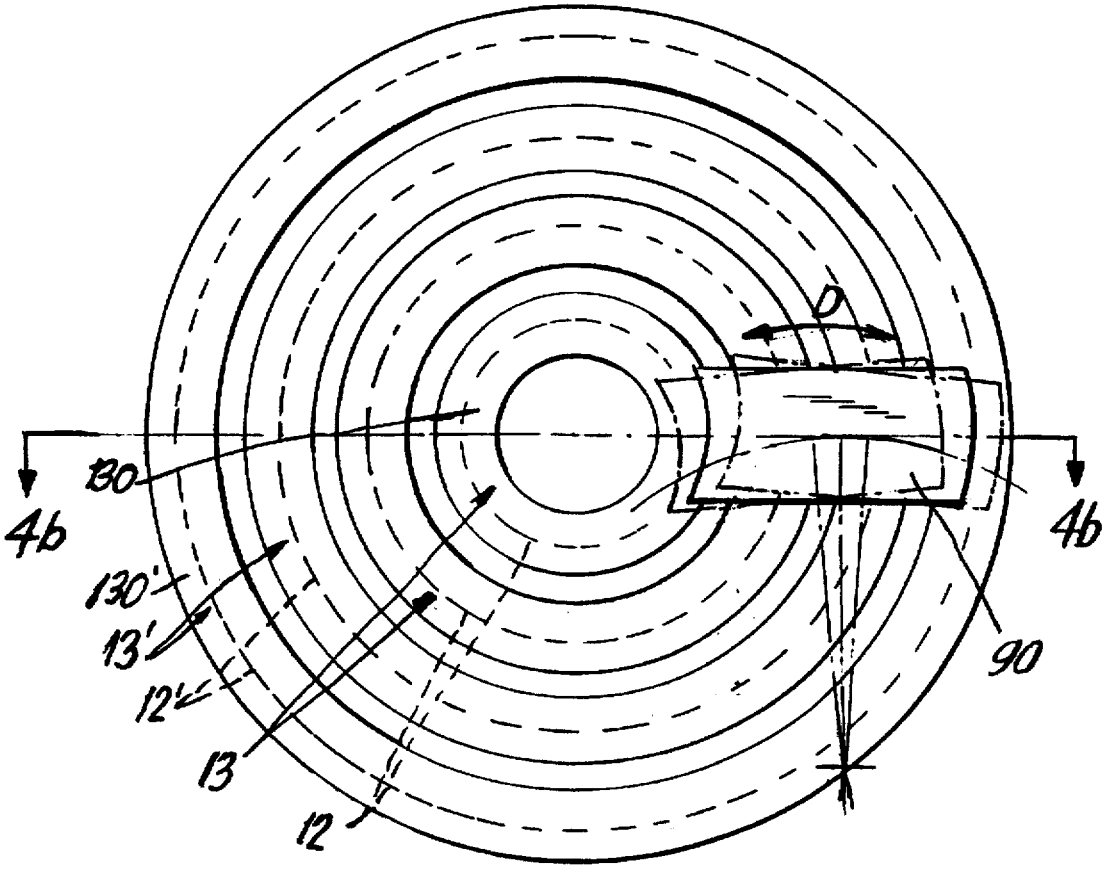
FIG. 4*a* is a side view of another embodiment of the gripper cylinder having two electromagnets configured as stationary annular rings.
Figure 4B:
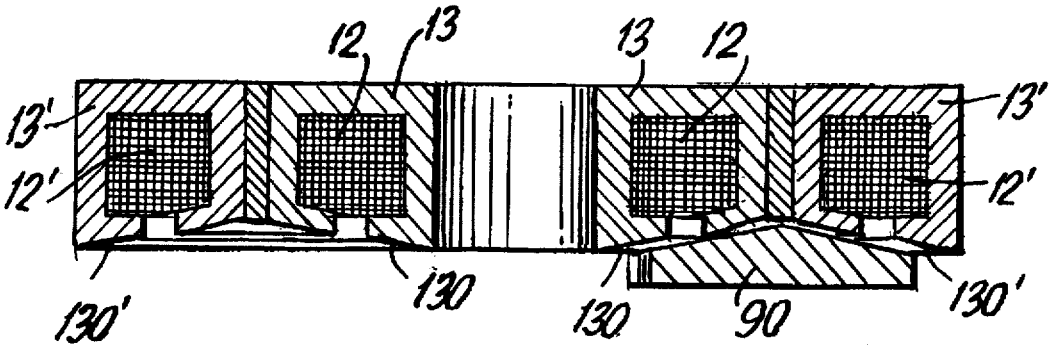
FIG. 4*b* is a cross-sectional view through the gripper cylinder along lines 4*b*—4*b* of FIG. 4*a*.

It is still further contemplated that instead of spring 8, a permanent magnet or another electromagnet may be provided as illustrated in FIGS. 4*a* and 4*b*. As shown in this embodiment, the gripping cylinder 1 includes a stator 12' a housing 13' and a housing lip 130'. Accordingly, the armature 90 can be moved or swung back and forth in the general directions indicated by Arrow D in FIG. 4*a*, depending on which of the two electromagnets has an electrical current flowing through it or, in the alternative, whichever has the stronger electrical current flowing therethrough and thereby produces the greater or more dominant torque or force on the armature 90 and accordingly, swinging with it the gripper spindle assembly 3. In the case of a permanent magnet, the armature can be caused to swing when the electromagnet of the stator has adequate electrical current flowing therethrough. In the gripper's closed position, the bearing surface of the gripper support 5 may act as a stop for the grippers 4 and thus also for the armature 90. Another stop for the armature 90 may also be provided by, for example, a bolt attached to the end face of the gripper cylinder 1. In accordance with this embodiment, it is not necessary to include a control cam or a cam roller.

It is yet further contemplated that the electromagnets may be attached in a stationary manner as, for example, a concentric or annular ring, to one or both end faces of the gripper cylinder 1 as shown in FIG. 3. In the case where only one electromagnet is used to swing or move the armature 9 or 90 against the restoring torque or force produced by a spring 8 or a permanent magnet, the electromagnet may also be arranged in a stationary manner.

In operation, the electromagnets can be controlled independently of the movement of the gripper cylinder 1 by, for example, an encoder.

Although only magnetic attraction as a control mechanism is discussed thus far, it can be readily understood that the above described embodiments may also employ the magnetic repulsion of magnets or electromagnets as a means to move the armature 9 or 90. Of course, magnetic repulsion may be attained by bringing the same magnetic poles of magnets or electromagnets in proximity to one another.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A printing machine, comprising:

a side wall;

a gripper cylinder, supported by said side wall, for selectively gripping and transporting a sheet, including:

a gripper spindle assembly mounted to the cylinder, said gripper spindle assembly including:

a gripper support having a bearing surface; and a gripper pivotably connected to said gripper support and being spaced a distance from said bearing surface such that said gripper may be pivoted toward said bearing surface so as to grip the sheet for at least a portion of a rotation of the cylinder, and an armature secured to said gripper; and a stator disposed in a stationary relation to said side wall and proximate the gripper cylinder, said stator including first magnetic means for selectively imparting a magnetic force to said armature so as to pivot said gripper.

2. The printing machine of claim 1, said first gripper spindle assembly further comprising a spring connected to said gripper so that a restoring torque is imparted to said gripper.

3. The printing machine of claim 1, wherein said first magnetic means is an electromagnet.

4. The printing machine of claim 3, wherein said first magnetic means includes a housing for guiding said armature for said at least a portion of the rotation of the cylinder, said housing having a substantially arcuate section.

5. The printing machine of claim 4, further comprising second magnetic means for imparting a restoring torque to said gripper, said second magnetic means being disposed proximate said armature.

6. The printing machine of claim 5, wherein said second magnetic means is a permanent magnet.

7. The printing machine of claim 5, wherein said second magnetic means is an electromagnet.

8. The printing machine of claim 5, wherein said second magnetic means includes a housing for guiding said armature for at least a portion of the rotation of the cylinder, said housing having a substantially arcuate section and being in a concentric relationship with said housing of said first magnetic means.

9. The printing machine of claim 8, wherein said armature is configured to be responsive to a combined force produced by said first and said second magnetic means.

10. The printing machine of claim 4, further comprising a cam roller rotatably mounted to the armature such that said cam roller and said armature are pivotable together, wherein said first magnetic means of said stator is arranged substantially as an annular ring in a stationary manner with respect to said side wall, said housing of said first magnetic means forms a continuous control cam for said cam roller so that said gripper selectively grips and releases the sheet at each selected number of rotations when an electrical current flows through said stator.

11. The printing machine of claim 4, wherein said housing forms an internal control cam.

12. The printing machine of claim 4, wherein said housing forms an external control cam.

13. The printing machine of claim 1, further comprising a stop disposed proximate said gripper, wherein said armature pivots between a close position in which said gripper is clamped against said bearing surface and an open position in which said gripper is pressed against said stop.

14. The printing machine of claim 1, further comprising an additional gripper spindle assembly, said gripper spindle assemblies being disposed around a circumference of the gripper cylinder.

15. The printing machine of claim 1, wherein the gripper cylinder is configured as a feeder drum in a sheet-fed printing machine.

16. The printing machine of claim 1, wherein the gripper cylinder is configured as a transfer drum in a sheet-fed printing machine.

17. The printing machine of claim 1, wherein the gripper cylinder is configured as a printing cylinder in a sheet-fed printing machine.

18. The printing machine of claim 1, wherein the gripper cylinder is configured as a gripper cylinder in a folding unit.

19. A gripper cylinder for selectively gripping and transporting a sheet, comprising:

a gripper spindle assembly mounted to the cylinder, said gripper spindle assembly including:

a gripper support having a bearing surface; and a gripper pivotably connected to said gripper support and being spaced a distance from said bearing surface such that said gripper may be pivoted toward said bearing surface so as to grip the sheet for at least a portion of a rotation of the cylinder, and an armature secured to said gripper;

a stationary stator disposed proximate the gripper cylinder, said stator including first magnetic means for selectively imparting a magnetic force to said armature so as to pivot said gripper, wherein said first magnetic means is an electromagnet and includes a housing for guiding said armature for said at least a portion of the rotation of the cylinder, said housing having a substantially arcuate section; and a cam roller rotatably mounted to the armature such that said cam roller and said armature are pivotable together, wherein said first magnetic means of said stator is arranged substantially as an annular ring in a stationary manner on an end face of the gripper cylinder, said housing of said first magnetic means forms a continuous control cam for said cam roller so that said gripper selectively grips and releases the sheet at each selected number of rotations when an electrical current flows through said stator.

* * * * *

UNITED STATES PATENT AND TRADEMARK OFFICE

CERTIFICATE OF CORRECTION

PATENT NO. : 5,678,486
DATED : Oct. 21, 1997
INVENTOR(S) : Bachmeir et al.

It is certified that error appears in the above-identified patent and that said Letters Patent is hereby corrected as shown below:

col. 2, line 17, after "outside" delete "of"

col. 3, line 14, delete "cylinder 2" and insert -- cylinder 1 --.

col. 4, line 10, delete "need" and insert -- needs --.

Signed and Sealed this

Ninth Day of March, 1999

*Attest:*

*Attesting Officer*

Q. TODD DICKINSON

*Acting Commissioner of Patents and Trademarks*